US008404424B2

(12) United States Patent
Schulze-Hagenest et al.

(10) Patent No.: US 8,404,424 B2
(45) Date of Patent: Mar. 26, 2013

(54) SECURITY ENHANCED PRINTED PRODUCTS AND METHODS

(75) Inventors: Detlef Schulze-Hagenest, Molfsee (DE); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/022,658

(22) Filed: Feb. 8, 2011

(65) Prior Publication Data

US 2012/0202011 A1 Aug. 9, 2012

(51) Int. Cl.
*G03G 13/20* (2006.01)

(52) U.S. Cl. ..... 430/123.4; 430/123.41; 430/123.5; 430/124.1; 430/124.4; 430/124.52

(58) Field of Classification Search ..... 430/123.4, 430/123.41, 123.5, 124.1, 124.4, 124.52
See application file for complete search history.

(56) References Cited

U.S. PATENT DOCUMENTS

| | | | | |
|---|---|---|---|---|
| 2,229,513 | A | 1/1942 | Lustig | |
| 3,694,359 | A | 9/1972 | Merrill et al. | |
| 3,809,554 | A | 5/1974 | Merrill et al. | |
| 3,893,935 | A | 7/1975 | Jadwin et al. | |
| 4,079,014 | A | 3/1978 | Burness et al. | |
| 4,089,472 | A | 5/1978 | Siegel et al. | |
| 4,160,644 | A | 7/1979 | Ryan | |
| 4,323,634 | A | 4/1982 | Jadwin | |
| RE31,072 | E | 11/1982 | Jadwin et al. | |
| 4,394,430 | A | 7/1983 | Jadwin et al. | |
| 4,414,152 | A | 11/1983 | Santilli et al. | |
| 4,416,965 | A | 11/1983 | Sandhu et al. | |
| 4,624,907 | A | 11/1986 | Niimura et al. | |
| 4,683,188 | A | 7/1987 | Suzuki et al. | |
| 4,780,553 | A | 10/1988 | Suzuki et al. | |
| 4,814,250 | A | 3/1989 | Kwarta et al. | |
| 4,833,060 | A | 5/1989 | Nair et al. | |
| 4,834,920 | A | 5/1989 | Bugner et al. | |
| 4,840,864 | A | 6/1989 | Bugner et al. | |
| 4,988,126 | A | 1/1991 | Heckenkamp et al. | |
| 5,105,451 | A | 4/1992 | Lubinsky et al. | |
| 5,604,076 | A | 2/1997 | Patel et al. | |
| 6,664,017 | B1 | 12/2003 | Patel et al. | |
| 7,139,521 | B2 | 11/2006 | Ng et al. | |
| 2003/0087176 | A1 | 5/2003 | Ezenyilimba et al. | |
| 2003/0203304 | A1* | 10/2003 | Katagiri et al. | 430/124 |
| 2006/0154180 | A1 | 7/2006 | Kannurpatti | |
| 2006/0230273 | A1 | 10/2006 | Crichton | |
| 2008/0233313 | A1 | 9/2008 | Chatow et al. | |
| 2009/0016776 | A1* | 1/2009 | Priebe et al. | 399/231 |
| 2010/0164218 | A1 | 7/2010 | Schulze-Hagenest et al. | |
| 2010/0232821 | A1 | 9/2010 | Zaretsky et al. | |

FOREIGN PATENT DOCUMENTS

| | | |
|---|---|---|
| DE | 42 02 461 | 3/1994 |
| DE | 42 02 462 | 6/1994 |
| DE | 100 11 299 | 8/1994 |
| EP | 0 003 905 | 5/1984 |
| EP | 1 270 246 | 1/2003 |
| EP | 1 521 128 | 4/2005 |
| GB | 1 420 839 | 1/1976 |

(Continued)

*Primary Examiner* — Hoa V Le
(74) *Attorney, Agent, or Firm* — Roland R. Schendler, II

(57) ABSTRACT

Printed products, printing methods and methods for verifying authenticity of a printed product are provided. In one aspect, the printed product has a receiver and an image formed thereon by an electrophotographic process using toner particles, said image having at least one raised portion, wherein at least parts of said raised portion of said image comprise phosphorescent or fluorescent toner particles.

9 Claims, 3 Drawing Sheets

FOREIGN PATENT DOCUMENTS

| | | |
|---|---|---|
| GB | 1 501 065 | 2/1978 |
| JP | 07-125403 | 5/1995 |
| JP | 2002-082582 | 3/2002 |
| WO | WO 2007/077455 | 7/2007 |
| WO | 2007/107272 | 9/2007 |
| WO | WO 2009/148276 | 12/2009 |

* cited by examiner

SECURITY ENHANCED PRINTED PRODUCTS AND METHODS

CROSS REFERENCE TO RELATED APPLICATIONS

This application relates to commonly assigned, copending U.S. application Ser. No. 13/022,660, filed Feb. 8, 2011, entitled: "PRINTED PRODUCT WITH RAISED AUTHENTICATION FEATURE"; and U.S. application Ser. No. 13/022,663, filed Feb. 8, 2011, entitled: "PRINTED PRODUCT WITH AUTHENTICATION BI-FLUORESCENCE FEATURE" each of which is hereby incorporated by reference.

FIELD OF THE INVENTION

This invention relates in general to a printed product and a method for forming a printed product on a receiver member.

BACKGROUND OF THE INVENTION

One common method for printing images on a receiver member is referred to as electrophotography. In this method, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) marking particles (generally referred to as toner particles) are given a charge, substantially opposite the charge pattern on the dielectric member and brought into the vicinity of the dielectric member so as to be attracted to the image-wise charge pattern to develop such pattern into a visible image.

Thereafter, a suitable receiver member (e.g., cut sheet of plain bond paper) is brought into juxtaposition with the toner particles thus developed in accordance with the image-wise charge pattern on the dielectric member, either directly or via an intermediate transfer member such as a transfer roller or a transfer belt. A suitable electric field is applied to transfer the toner particles to the receiver member in the image-wise pattern to form the desired print image on the receiver member. The receiver member is then removed from its operative association with the dielectric member and subjected to heat and/or pressure to permanently fix (typically referred to as fusing) the toner particle print image to the receiver member. Plural toner particle images of, for example, different color particles respectively can be overlaid in the above manner on the receiver member before fusing to form a multi-color print image.

In the earlier days of electrophotographic printing, the toner particles were relatively large (e.g., on the order of 10-15 μm. As a result the print image had a tendency to exhibit an unwanted and not reproducible weak relief appearance (variably raised surface). Under most circumstances, the relief appearance was considered an objectionable artifact in the print image. In order to improve image quality, and to reduce relief appearance, over the years, smaller marking particles (e.g., on the order of less than 8 μm have been formulated and are more commonly used today. In order to achieve higher resolutions and to reduce toner consumption there is a tendency to reduce the size of the marking particles even more.

With the improved print image quality, print providers and customers alike have been looking at ways to expand the use of electrophotographically produced prints. In certain classes of printing, a tactile feel to the print, is not objected to, in particular, when the tactile feel can be controlled by providing raised information at selected regions only. Such raised information can be used to authenticate certain print products by tactile feel. If such print products are attached to or accompany a particular product, the print product may provide valuable information with respect to authenticity of the product itself.

Product counterfeiting occurs on a multitude of products such as artworks, CDs, DVDs, computer software recorded on CDs or diskettes, perfumes, designer clothes, handbags, briefcases, automobile and airplane parts, securities (e.g. stock certificates), identification cards (driver's licenses, passports, visas, green cards), credit cards, smart cards, and pharmaceuticals. According to the World Health Organization, a substantial percentage of the world's pharmaceuticals is bogus and may indeed be detrimental to the patient consuming the same. Thus there is a need to authenticate products.

The application of security markers to a object or product for authenticating the origin and intended market of the object product are known in the prior art. Such security markers can be incorporated into components which make up the object or can be incorporated into papers, inks, or varnishes that are applied to the object or into labels affixed to the object or packaging for the object. The presence of such security markers verifies the authentic origin of the object and is verified by means suited to the particular nature of the marker. Examples for such security markers are RFID-tags and holograms.

Both of these markers can be detected by non-destructive non contact methods. For example, authentication devices can be used which detect the electronic or optical properties of the markers, in situ, without the need to alter or destroy the object on which they reside. As such they provide means for authenticating a product. However, the costs associated with both markers are relatively high and thus are not widely used for high volume, low cost applications.

Using a raised print, which provides a tactile feel, as discussed above, also provides a means for authenticating a print product and thus possibly another product accompanying the same, albeit at a much lower cost. The tactile feel or the lack thereof can be easily recognized by the end user. Providing a tactile feel alone to authenticate a product, however, may not be sufficiently reliable, especially in an automated environment.

SUMMARY OF THE INVENTION

This invention is directed to a printed product and a method for producing a printed product that enables authentication thereof in a manner that overcomes one or more of the above deficiencies.

In accordance with a first aspect of this invention, a printed product, comprising a receiver member; and an image formed thereon by an electrophotographic printing process using toner particles is provided. The image has at least one raised portion comprising phosphorescent or fluorescent toner particles. The raised portion may provide a tactile feel, which can be used to authenticate the print product. The phosphorescent or fluorescent toner particles can also be used to authenticate the printed product. Such authentication may for example be performed by stimulating the toner particles to emit radiation by phosphorescence or fluorescence, respectively and by detecting this radiation by an appropriate sensor. Due to the fact that that the phosphorescent or fluorescent toner particles are provided in the raised portion, the sensor can be directed onto the surface of the printed product under a flat angle and still be in a position to detect the radiation. Thus, the combination of the raised portion and the phosphorescent or fluorescent toner particles allows reliable authentication of a printed product by two different methods.

In accordance with a second aspect of the invention, a method for forming a printed product on a receiving member is provided. The method comprises applying at least one toner layer by an electrophotographic printing process on said receiver member for forming an image such that said image has at least one raised portion comprising a layer of phosphorescent or fluorescent toner particles. After the application of the at least one toner layer, the at least one toner layer is fused to said receiver member. The method allows forming a printed product having raised portions comprising phosphorescent or fluorescent toner particles, thereby enabling the above features with respect to authenticating the print product. Printed products comprising phosphorescent or fluorescent toner emit e.g. green, blue, orange or red light, as described in U.S. Publication No. 20100164218 published Jul. 1, 2010, METHOD FOR PROVIDING PRINTS WITH FLUORESCENT EFFECTS AND THE PRINT ITEM, which is incorporated herein by reference in its entirety.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
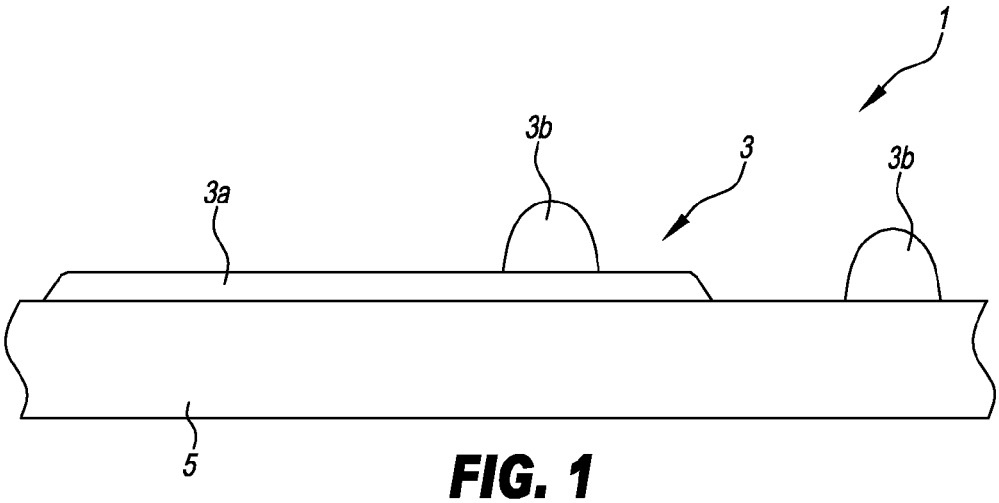
FIG. 1 is a schematic side elevational view of a printed product having an image formed thereon, which image has raised portions.

FIG. 1 shows a schematic side elevational view of a printed product 1 having an image 3 formed on a receiver member 5 by electrophotography. The image 3 has a flat portion 3*a* and raised portions 3*b*.

The flat portion does not provide a tactile feel and preferably does not have a height of more than 10 μm, preferably not more than 8 μm above the surface of the receiver member. The raised portions 3*b* are sufficiently high to provide a tactile feel. The raised portions 3*b* should have a heights difference with respect to a surrounding area of at least 15 μm, preferably of at least 20 μm. As shown, such raised portions 3*b* can be formed directly on the receiver member 5 or on the flat portion 3*a*, which then forms the surrounding area for the raised portion. The receiver member can be of any material suitable for electrophotographic printing thereon, such as cut sheet of plain bond paper, foils etc.

The image 3 is formed by an electrophotographic process, as described above. First a latent image is formed on a dielectric member, which latent image is developed with toner particles. The developed toner particles are then transferred to the receiver member to form a toner image thereon. As is known, a plurality of layers of toner particles can be applied to the receiver member using a plurality of printing modules. The toner particles forming the image are subsequently fused, in order to be well adhered to the receiver member. This fusing can be done by a number of means such as heating alone or by passing the image thru a pair of heated rollers to thereby apply heat and pressure to the toner particles. Of these, a pair of heated rollers is the most commonly used method for fusing an image to a receiver member. Generally, one of the rollers is heated to a higher temperature and may have an optional release fluid applied to its surface. This roller is usually referred to as the fuser roller. The other roller is typically heated to a much lower temperature and usually serves the function of applying pressure to the nip formed between the rollers as the toner image is passed therethrough. The second roller is therefore typically referred to as a pressure roller.

As the toner image is passed through the nip formed between the rollers, the toner is softened as its temperature is increased on contact with the fuser roller. There is some spreading of the toner volume due to pressure and any void volume between toner particles is removed by the action of pressure and temperature. Unlike the off-set printing or ink jet applications, where most of the marking particles penetrate into the substrate fibers, the toner melt typically remains entirely above the receiver member.

In a typical fusing step using fuser rollers, the pile height of the toner laydown is reduced by approximately half the volume diameter of the toner as a result of spreading and elimination of the void space in between toner particles. Such laydown can be less with fusing methods using heat alone like IR-radiant, flash or microwave fusing. Hence, when a uniform laydown of, for example, an 8-micron toner is fused, the resulting stack height is only about 4 microns.

The basic premise for producing foreground raised information with a tactile feel is that the selected information will exhibit the desired tactile feel when the fused toner particle stack height T is at least 15 μm, preferably greater than 20 μm. In electrophotographic printing (EP), the toner development can be limited to roughly a double layer per printing module due to counter charge issues. Thus, in order to obtain an image having greater than 20 microns of relief from a single printing module, particles much larger than 8 microns would be needed if raised information is to be printed. Such particle size, however, is detrimental for high resolution printing and toner consumption, as pointed out above. Thus, such toner should preferably be used for special raised printing only.

Figure 4:
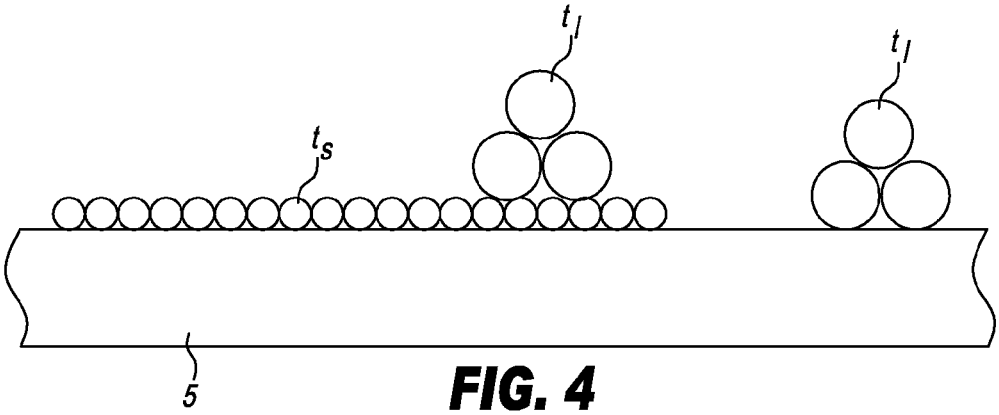
FIG. 4 is a schematic side elevational view, in cross section, of a receiver member having an alternative toner particle image formed thereon prior to a fusing step.

The stack height T of at least 30 μm, preferably greater than 40 μm prior to fusing, corresponding roughly to a stack height of 15 μm, preferably greater than 20 μm after fusing can also be produced using several imaging modules by selectively building up layer upon layer of toner particles $t_s$ of a standard general average mean volume weighted diameter of less than 9 μm (see FIG. 4). However, this may limit the number of available imaging modules for depositing toner for normal toner image formation.

Figure 5:
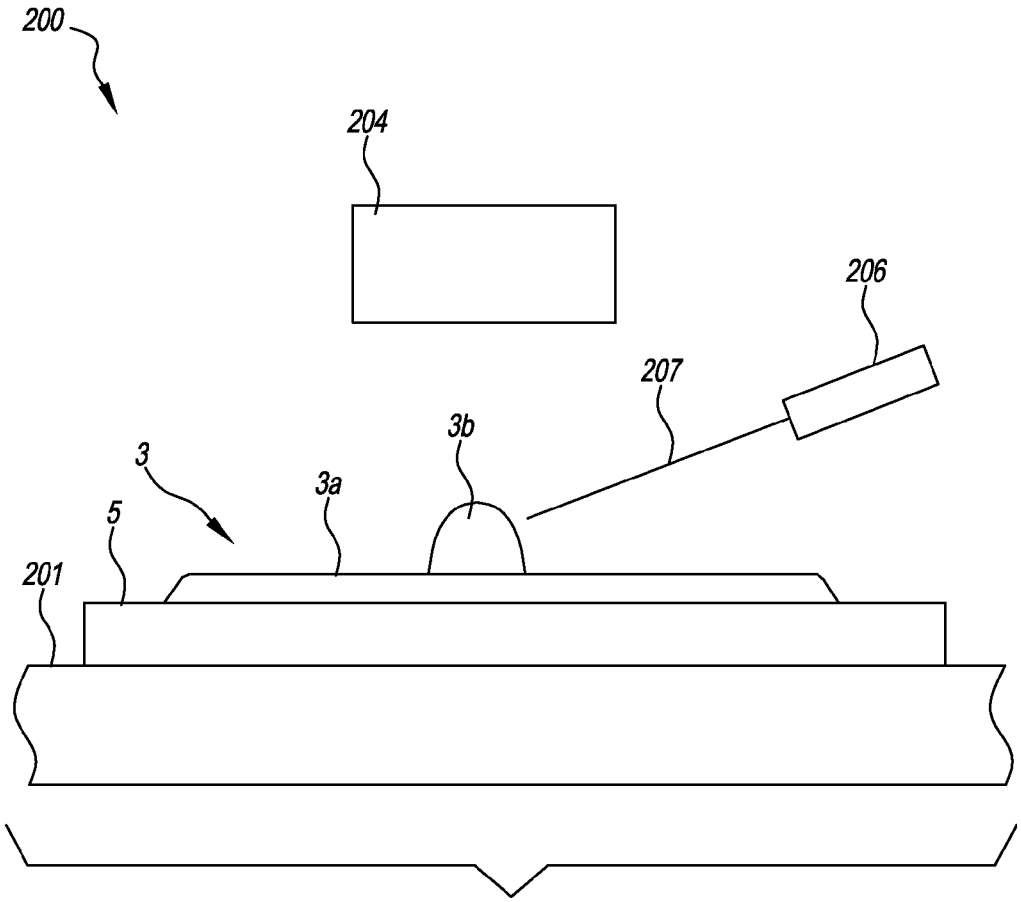
FIG. 5 is a schematic side elevational view of an authenticating unit for a printed product having raised portions.

Using a larger size specialized toner for raised printing in an imaging module to more rapidly build up the toner mass laydown, and hence height, can be a more practical method for producing high relief images. A larger or large size toner in accordance with this application is a toner having toner particles $t_l$ of a standard general average mean volume weighted diameter of more than 18 μm, preferably more than 20 μm. Such larger toner particles $t_l$ can be deposited upon previously deposited layers of smaller sized toner particles $t_s$ for providing raised image areas on for example a multi color image, as shown in FIG. 5. In this case it would be beneficial if the specialized toner is a clear toner. The larger sized toner particles $t_l$ can also be deposited in areas adjacent to previously deposited layers of smaller sized toner particles $t_s$ for example providing raised background areas outside a color toner image, as also shown in FIG. 5, a combination of effects can also be achieved by depositing the larger sized toner on both the background and previously toned areas. Since in accordance with the invention, it is desired to provide a phosphorescent or fluorescent toner in the raised information, it would be beneficial, if a phosphorescent or fluorescent material is incorporated into the larger size toner particles $t_l$ thereby ensuring phosphorescent toner being present in the raised portions.

When referring to toner particles, the toner size or diameter is defined in terms of the mean volume weighted diameter as measured by conventional diameter measuring devices such as a Coulter Multisizer, sold by Coulter, Inc. The mean volume weighted diameter is the sum of the mass of each toner particle multiplied by the diameter of a spherical particle of equal mass and density, divided by the total particle mass.

Large toner particles $t_l$ may create problems during the development thereof, when a two-component developer comprising the above mentioned larger toner particles $t_l$ and a standard carrier—having particles of a general average mean volume weighted diameter in the range of 20 to 23 microns—is used. When carrier particles in this size range are used with larger toner particles $t_l$ that are about 20 microns in volume average diameter, the carrier particles tend to develop along with the toner in an image-wise fashion. Thus, when using the larger toner particles, also larger carrier particles should be used, despite the fact that for the highest image quality and improved addressability, the smallest carrier size is preferred.

When very large carrier particles are used, the image wise carry-out of carrier particles is avoided, but the precise registration of the toner stack is compromised. In order to get the maximum tactile feel, it is necessary that precise registration is maintained. It was found out that good registration with little or no carry-out of carrier particles can be achieved if the following was observed: a) toner particle size is larger than 18 microns volume average diameter and preferably between 20 and 50 microns and more preferably between 20 and 30 microns volume average diameter; b) carrier particle size is larger than the toner particle size employed and ranges between 25 and 60 microns; c) difference between the volume average diameter for carrier and toner particles used is greater than 5 microns or the ratio of carrier-to-toner volume average diameter exceeds 1.25; and d) the overlap in the volume average distribution of toner and carrier particle size is less than 35%. Preferably, toner images formed in accordance with the present invention are formed using such a two component toner/developer system.

One or more toner resins can be present in the toner particles or toner formulations used in the present invention. Specialized large toner particles tl used for raised printing preferably have a median volume diameter of from about 18 microns to about 50 microns. The toner resin can be any conventional polymeric resin or combination of resins typically used in toner formulations using conventional amounts. The following discussion relates to optional components that can also be present in the toner particles or formulations of the present invention. The polymers useful as toner binders in the practice of the present invention can be used alone or in combination and include those polymers conventionally employed in electrostatic toners. Useful amorphous polymers generally have a glass transition temperature within the range of from 50° C. to 120° C. Preferably, toner particles prepared from these polymers have relatively high caking temperature, for example, higher than about 60° C., so that the toner powders can be stored for relatively long periods of time at fairly high temperatures without having individual particles agglomerate and clump together. The melting point of useful crystalline polymers preferably is within the range of from about 65° C. to about 200° C. so that the toner particles can readily be fused to a conventional paper receiving sheet to form a permanent image. Especially preferred crystalline polymers are those having a melting point within the range of from about 65° C. to about 120° C. Of course, where other types of receiving elements are used, for example, metal plates such as certain printing plates, polymers having a melting point or glass transition temperature higher than the values specified above can be used.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in U.S. Pat. No. Re. 31,072.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 90% styrene) are also useful binders. A useful binder can also be formed from a copolymer of a vinyl aromatic monomer; a second monomer selected from either conjugated diene monomers or acrylate monomers such as alkyl acrylate and alkyl methacrylate.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic dials, such as polyesters of isophthalic or terephthalic acid with dials such as ethylene glycol, cyclohexane dimethanol, and bisphenols.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties are also useful. Among such other useful polyesters are copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be a halogen-substituted alkane), and an alkyl ene glycol having from 1 to 4 carbon atoms in the alkylene moiety.

Typically, the amount of toner resin present in the toner formulation is from about 85% to about 95%. Various kinds of well-known addenda (e.g., colorants, release agents, etc.) can also be incorporated into the toners of the invention. In accordance with the present invention, the specialized large toner particles tl preferably include phosphorescent or fluorescent material and no colorant. Alternatively, numerous colorant materials selected from dyestuffs or pigments can also be employed in the large size toner particles in combination with the phosphorescent or fluorescent material, if desired. Such phosphorescent or fluorescent material serves the above described authentication process or to render a printed product more unique.

There is a wide variety of phosphorescent and fluorescent materials that can be utilized with the present invention. Examples of phosphorescent materials include, but are not limited to, CaS:Bi (which emits light of violet blue), CaStS:Bi (which emits light of blue), ZnS:Cu (which emits light of green), ZnCdS:Cu (which emits light of yellow or orange), ZnS:Cu, Co and CaSrS:Bi. Additional phosphorescent materials are disclosed in U.S. Pat. No. 6,117,362.

As fluorescent material a dye that absorbs light in the UVA range 380-380 nm and emits red light as described in WO 2007/107272 may be used. The structure of an example of such a dye is

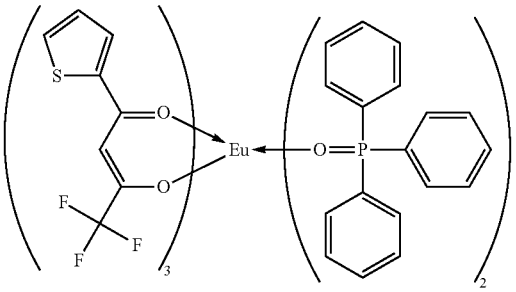

In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. Colorants are generally employed in the range of from about 1 to about 30 weight percent on a total toner powder weight basis, and preferably in the range of about 2 to about 15 weight percent. The toner particles can include one or more toner resins which can be optionally colored by one or more colorants by compounding the resin (s) with at least one colorant and any other ingredients. Although coloring is optional, normally a colorant is included and can be any of the materials mentioned in Colour Index, Volumes I and II, Second Edition, incorporated herein by reference. With respect to the fuser release additives, the polyalkylene wax can also serve the purpose as a suitable release agent. Alternatively or in addition, a wax can be used that has a percent crystallinity of 70% or more as measured by DSC. Preferably, the percent crystallinity is 80 to 99%. The wax can be a polyalkylene wax or other types of waxes.

Furthermore, the wax preferably has a number average molecular weight of about 500 or higher and more preferably a number average molecular weight of from about 500 to about 7,000, and even more preferably a number average molecular weight of from about 1,000 to about 3,000. With respect to the polyalkylene wax, the polyalkylene wax can also serve the purpose as a suitable release agent. The polyalkylene wax, as indicated above, has a polydispersity of 2.0 or higher. Alternatively, the polyalkylene wax has a number average molecular weight of from about 500 or higher polydispersity number. More preferably, the polyalkylene wax that is present has a polydispersity of from 2.0 to about 10.0 and more preferably a polydispersity of from 3.0 to about 5.0. The polydispersity is a number representing the weight average molecular weight of the polyalkylene wax divided by the number average molecular weight of the polyalkylene wax.

In addition, the wax of the present invention preferably has a melting temperature onset of from about 70° C. to about 130° C. The melting temperature onset is calculated by identifying the temperature at which a melting transition is exhibited first in a Differential Scanning Calorimeter (DSC) scan by showing a departure from the baseline. DSC scans were obtained using a Perkin Elmer DSC 7. A toner weight of 10 to 20 mg was used at a heating and cooling rate of 10° C. per minute. Preferably, the wax that is present in the toner formulations used in the present invention has all four of the above-described properties or can have one, two, or three of the properties in any combination.

Examples of suitable polyalkylene waxes include, but are not limited to, polyethylene or polypropylene, such as Peterolite Polywax 500, Polywax 1000, Clariant Licowax PE130, Licowax PE190, Viscol 550 or 660 from Sanyo and the like. Also useful are ester waxes available from Nippon Oil and Fat under the WE-series waxes.

The amount of the wax that is present in the toner formulations of the present invention can be any suitable amount to accomplish the benefits mentioned herein. Examples of suitable amounts include, but are not limited to, from about 0.1 to about 10 weight percent and more preferably from about 1 to about 6 weight percent based on the toner weight. Other suitable amounts are from about 1 part to about 5 parts based on a 100 parts by weight of the toner resin present. Though not necessary, other conventional waxes can be additionally present, such as other polyolefin waxes and the like.

As indicated above, at least one charge control agent can be present in the toner formulations of the present invention. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl) azo]-3-hydroxy-N-phenyl-2-naphthalenecarboxamidato (2-)], ammonium, sodium, and hydrogen (Organoiron available from Hodogaya Chemical Company Ltd.). Additional examples of suitable charge control agents include, but are not limited to, acidic organic charge control agents. Particular examples include, but are not limited to, 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived therefrom. Other examples include charge control agents with one or more acidic functional groups, such as fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide.

Another class of charge control agents include, but are not limited to, iron organo metal complexes such as organo iron complexes. A particular example is T77 from Hodogaya. Preferably, the charge control agent is capable of providing a charge. For purposes of the present invention, a preferred consistent level of charge is from about −5 to about −12 micro C/gm. The charge control agent(s) is generally present in the toner formulation in an amount to provide a consistent level of charge and preferably provide a consistent level of charge of from about −5 to about −12 micro C/gm in the toner formulation upon being charged. Examples of suitable amounts include from about Vi part to about 6 parts per 100 parts of resin present in the toner formulation. With respect to the surface treatment agent, also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 1.5 weight percent, and more preferably from about 0.1 to about 1.0 weight percent, and most preferably from about 0.2 to 0.6 weight percent, based on the weight of the toner. The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention. The mixing conditions should be gentle enough such that the large toner particles are not fractured by the collision with the wall of the Henschel mixer as they are agitated by the mixing blade/propeller. At too high a mixing speed, generation of fines particles is often observed with these larger toner particles owing to their large mass. The preferred spacing agent is silica, such as those commercially available from Degussa, like R972, RY200 or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 [mu]m in diameter (more preferably about 0.1 [mu]m), such as acrylic polymers, silicone-based polymers, styrenic polymers, fluoropolymers, copolymers thereof, and mixtures thereof. These metal oxide particles can be optionally treated with a silane or silicone coating to alter their hydrophobic character. In the preferred embodiment, a mixture of hydrophobic silica is used along with the hydrophobic titania to provide the optimum results for charging behavior and powder flow properties.

The toner formulations can also contain other additives of the type used in conventional toners, including magnetic pigments, colorants, leveling agents, surfactants, stabilizers, and the like. In a typical manufacturing process, the desired polymeric binder for toner application is produced independently. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The melt product is cooled and then pulverized to a volume average particle size of from about 18 to 50 micrometers. It is generally preferred to first grind the melt product prior to a specific pulverizing operation. The grinding can be carried out by any convenient procedure. For example, the solid toner can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

In place of melt blending or the like, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles. The toner formulation can also be made using various chemical methods known in the toner industry.

Chemical processes to be used are, among others, suspension polymerization (e.g., DE 4202461, DE 4202462); emulsion aggregation (e.g., U.S. Pat. No. 5,604,076, issued on Feb. 18, 1997); micro-encapsulation (e.g., DE 10011299); dispersion (e.g., U.S. Publication No. 2003/0087176 A1, published on May 8, 2003); or chemical milling (e.g., proceedings of IS&T NIP 17: International Conference on Digital Printing Technologies, IS&T: The Society for Imaging Science and Technology, 7003 Kilworth Lane, Springfield, Va. 22151 USA ISBN: 0-89208-234-8, p. 345). Other methods include those well-known in the art such as spray drying, melt dispersion, and dispersion polymerization. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

To be utilized as toners in the electrostatographic developers of the invention, the toners of this invention can be mixed with a carrier vehicle. The carrier vehicles, which can be used with the present toners to form the developer can be selected from a variety of materials. Such materials include carrier core particles and core particles overcoated with a thin layer of a film-forming resin. Preferably, when large size toner particles $t_l$ are used, the above mentioned relations should be observed.

Figure 2:
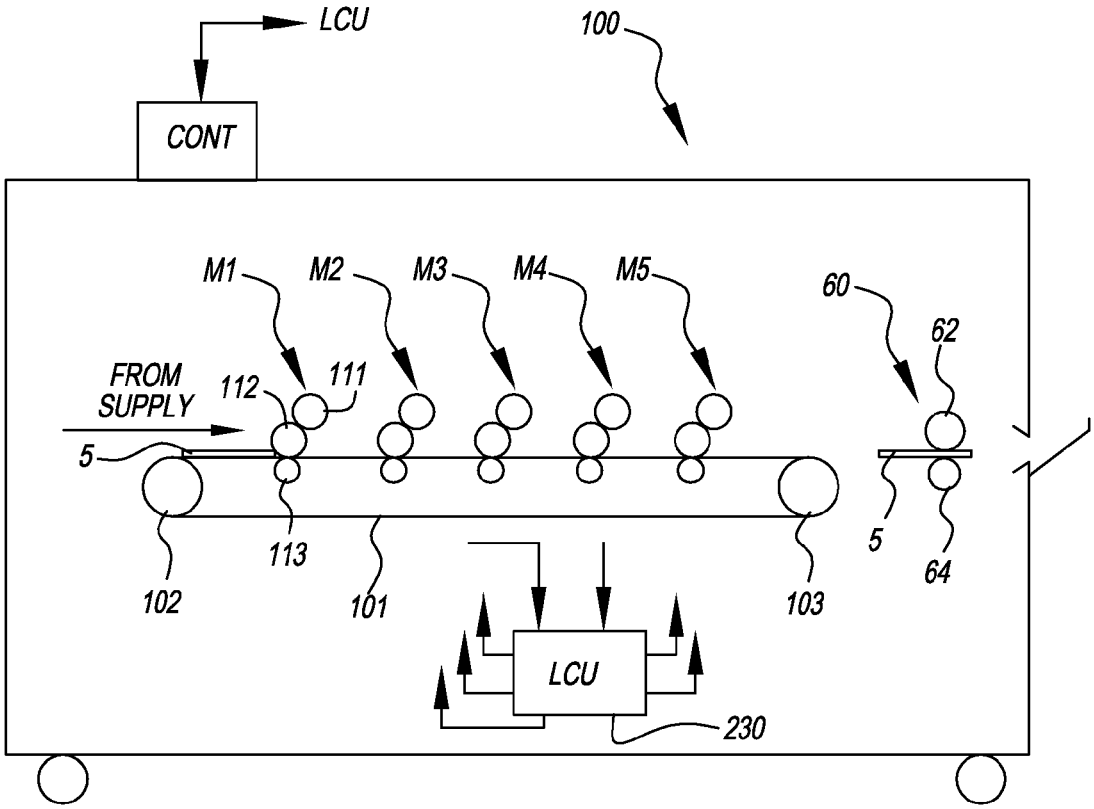
FIG. 2 is a schematic side elevational view, in cross section, of a typical electrophotographic reproduction apparatus suitable for use with this invention.

Referring now to the accompanying drawings, FIG. 2 is side elevational views schematically showing portions of a typical electrophotographic print engine or printer apparatus suitable for printing of pentachrome images. Although one embodiment of the invention involves printing using an electrophotographic engine having five sets of single color image producing or printing stations or modules arranged in tandem, the invention contemplates that more or less than five colors can be combined on a single receiver member, or may include other typical electrophotographic writers or printer apparatus.

An electrophotographic printer apparatus 100 has a number of tandemly arranged electrostatographic image forming printing modules M1, M2, M3, M4, and M5. Each of the printing modules generates a single-color toner image for transfer to a receiver member successively moved through the modules. Each receiver member, during a single pass through the five modules, can have transferred in registration thereto up to five single-color toner images to form a pentachrome image. As used herein the term pentachrome implies that in an image formed on a receiver member may comprise combinations of subsets of the five colors to form other colors on the receiver member at various locations on the receiver member. All five colors may participate to form process colors in at least some of the subsets wherein each of the five colors can be combined with one or more of the other colors at a particular location on the receiver member to form a color different than the specific color toners combined at that location. In a particular embodiment, printing module M1 forms black (K) toner color separation images, M2 forms yellow (Y) toner color separation images, M3 forms magenta (M) toner color separation images, and M4 forms cyan (C) toner color separation images. Printing module M5 may preferably form a clear separation image having phosphorescent or fluorescent characteristics. The Printing module M5 may alternatively also form a color separation image of any desired color, while still having phosphorescent or fluorescent characteristics. In the following description, it is assumed that each of the printing modules M1-M4 use a standard toner having standard size toner particles $t_s$, while printing module M5 uses a specialized toner having large size toner particles $t_l$ for raised printing. As explained above, raised printing may, however, also be achieved by using standard size toner in each of the printing modules and by building up several layers of toner particles $t_s$. Furthermore, large size toner can also be additionally or alternatively used in one or more of printing modules M1-M4. The phosphorescent or fluorescent characteristics of the toner can be provided for any one of the toners, but is preferably included in specialized large size toner for raised printing.

It is well known that the four primary colors cyan, magenta, yellow, and black can be combined in various combinations of subsets thereof to form a representative spectrum of colors and having a respective gamut or range dependent upon the materials used and process used for forming the colors. However, in the electrophotographic printer apparatus, a fifth color can be added to improve the color gamut. In addition to adding to the color gamut, the fifth color can also be used as a specialty color toner image, such as for making proprietary logos, or a clear toner for image protective purposes.

Receiver members 5 as shown in FIG. 2 are delivered from a paper supply unit (not shown) and transported through the printing modules M1-M5. The receiver members are adhered (e.g., preferably electrostatically via coupled corona tack-down chargers (not shown)) to an endless transport web 101 entrained and driven about rollers 102, 103.

Each of the printing modules M1-M5 includes a photoconductive imaging roller 111, an intermediate transfer roller 112, and a transfer backup roller 113, as is known in the art. Thus in printing module M1, a black color toner separation image can be created on the photoconductive imaging roller 111, transferred to intermediate transfer roller 112, and transferred again to a receiver member 5 moving through a transfer station, which transfer station includes intermediate transfer roller 112 forming a pressure nip with a corresponding transfer backup roller 113.

A receiver member may sequentially pass through the printing modules M1-M5. In each of the printing modules a toner separation image can be formed on the receiver member 5 to provide a pentachrome image as is known in the art.

The electrophotographic printer apparatus 100 has a fuser of any well known construction, such as the shown fuser assembly 60 using fuser rollers 62, 64. Even though a fuser assembly 60 using fuser rollers 62, 64 is shown, it is noted that different non-contact fusers using primarily heat for the fusing step can be beneficial as they may reduce compaction of toner layers formed on the receiver member 5, thereby enhancing tactile fell.

A logic and control unit 230 (FIG. 2) includes one or more processors and in response to signals from various sensors associated with the electrophotographic printer apparatus 100 provides timing and control signals to the respective components to provide control of the various components and process control parameters of the apparatus in accordance with well understood and known employments.

Although not shown, the electrophotographic printer apparatus 100 may have a duplex path to allow feeding a receiver member having a fused toner image thereon back to printing modules M1-M5. When such a duplex path is provided two sided printing on the receiver member, or multiple printing on the same side, which can be beneficial in realizing raised image portions is possible. As the skilled person will realize, in a double sided printing application, a raised print can be best achieved during printing on the second side, as the raised portion only passes once through the fuser.

In the following, operation of the electrophotographic printer apparatus 100 will be described. Image data for writing by the electrophotographic printer apparatus 100 are received and can be processed by a raster image processor (RIP), which may include a color separation screen generator or generators. The image data includes information about raised information to be formed on a receiver member, which information is also processed by the raster image processor. The output of the RIP can be stored in frame or line buffers for transmission of the color separation print data to each of the respective printing modules M1-M5 for printing color separations for K, Y, M, C, and R (which stand for black, yellow, magenta, cyan, and raised, respectively, assuming that the fifth printing module uses large size clear toner having phosphorescent or fluorescent characteristics). The RIP and/or color separation screen generator can be a part of the printer apparatus or remote therefrom. Image data processed by the RIP may at least partially include data from a color document scanner, a digital camera, a computer, a memory or network which the image data typically includes image data representing a continuous image that needs to be reprocessed into halftone image data in order to be adequately represented by the printer. Additionally, the image data includes date with respect to generating raised portions, which data can be provided separately or which can be incorporated in the image data.

There are several ways in which raised image data can be generated for raised printing. The raised image data can for example be generated by a digital front end (DFE) from original CMYK color data that uses the inverse mask technique of U.S. Pat. No. 7,139,521, issued Nov. 21, 2006, in the names of Yee S. Ng et al which is incorporated by reference.

In one alternative, a DFE can be utilized to store objects type information, such as text, line/graphics, or image types, to each rendered CYMK color pixel during raster image processing (RIP). In another alternative, an operator may choose special texture appearance adjacent or on top of CMYK image objects. The DFE renders raised image data accordingly and sends the data to the press for printing.

The RIP may perform image processing processes including color correction, etc. in order to obtain the desired color print. Color image data is separated into the respective colors and converted by the RIP to halftone dot image data in the respective color using matrices, which comprise desired screen angles and screen rulings. The RIP can be a suitably programmed computer and/or logic devices and is adapted to employ stored or generated matrices and templates for processing separated color image data into rendered image data in the form of halftone information suitable for printing.

Figure 3:
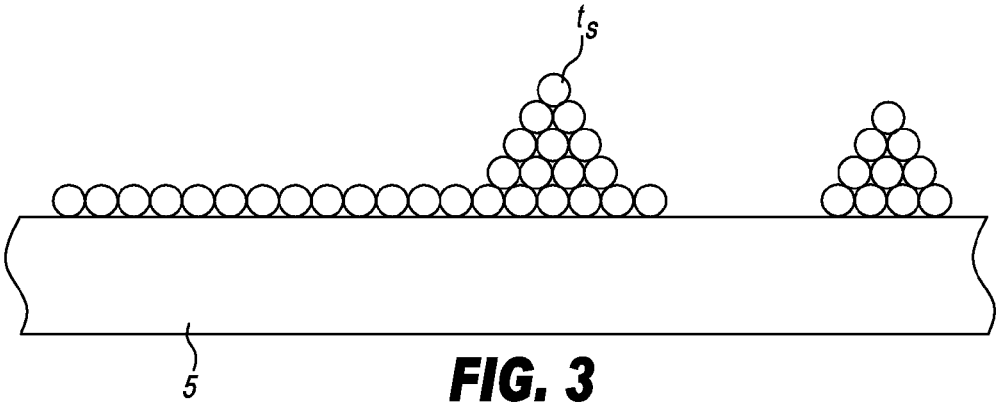
FIG. 3 is a schematic side elevational view, in cross section, of a receiver member having a toner particle image formed thereon prior to a fusing step.

A receiver member 5 is passed through the printing modules M1-M5, where up to five toner separation images are applied (in certain applications not all colors are used for printing) in superposed relationship to the receiver member. Raised print information is generated by the use of large toner particles the use of standard toner particles $t_s$ which are printed to obtaining at least three, preferably four or more superposed layers thereof (see FIG. 3), or by using both large toner particles $t_l$ and standard toner particles $t_s$, which can be printed to at least partially form superposed layers (see FIG. 4). The raised portions are printed in a manner that toner particles containing phosphorescent or fluorescent material is present the raised portion(s). Subsequently, the receiver member is passed through the fuser assembly 60 to fuse or fix the resultant toner image to the receiver member. Even after fusing, the raised portions have a sufficient height difference with respect to the surrounding area that it may result in a tactile feel. A height difference of 15 μm is considered to be sufficient, but a height difference of at least 20 μm is preferred for the raised portion(s). Such a printing process thus forms a printed product 1 as shown in FIG. 1. As shown, the printed product is formed a receiver member 5 having an image 3 formed thereon. The image 3 has a flat portion 3*a* and raised portions 3*b*. The flat portion does not provide a tactile feel and preferably does not have a height of more than 10 μm, preferably not more than 8 μm, above the surface of the receiver member 5. The raised portions 3*b* are sufficiently high to provide a tactile feel. The raised portions 3*b* should have a heights difference with respect to a surrounding area of at least 15 μm, preferably of at least 20 μm. As shown, such raised portions 3*b* can be formed directly on the receiver member 5 or on the flat portion 3*a*, which then forms the surrounding area for the raised portion.

*Fig.* 5 shows a side elevational view of an authenticating unit 200 for a printed product 1 having raised portions. The printed product 1, which can be formed in the above described manner, is placed on a support 201 such that raised portions 3*b* of the image 3 on the receiver member 5 face upwards. A radiation unit 204 for stimulating emission from the phosphorescent or fluorescent material in the raised portions 3*b* is provided above the support 201. The radiation unit 204 may stimulate the emission by using light radiation or any other radiation suitable for stimulating the phosphorescent or fluorescent material to emit. A radiation detector 206 is provided, for detecting radiation emitted from the phosphorescent or fluorescent material. The radiation detector 206 is of any suitable type to detect and possible specify the radiation emitted by the phosphorescent or fluorescent material. The radiation detector 206 has a limited field of view, which is specifically directed onto the surface of the printed product 1, where a raised portion 3*b* is expected. The radiation detector 206 has a certain detection direction as indicated by line 207, which is preferably arranged at a flat angle with respect to the surface of the printed product. Such flat angle may result in proper detection of the stimulated emission from the phosphorescent or fluorescent material only, when it is emitted from a raised portion, i.e. when the detector sees unto a surface of the raised portion which is at least partially at an angle significantly steeper than the flat angle with respect to the surface of the printed product. The flat angle can be at an angle with respect to the non-raised image portion, which is below the angle of total reflection. The arrangement thus enables distinction between emissions from normal image portions (some emissions may reach the detector but not sufficient) and raised portions (sufficient radiation reaches the detector). The phosphorescent or fluorescent material is irradiated with radiation of a specific bandwidth to stimulate the phosphorescent or fluorescent material. This enables to limit stimulated emission to phosphorescent or fluorescent materials, which are compatible to the specific radiation. Furthermore, the sensor can be designed to detect specific phosphorescent or fluorescent radiation only. This may for example be achieved by filtering phosphorescent or fluorescent radiation before it reaches a sensor surface of the sensor. Such filtering can be designed to let only specific phosphorescent or fluorescent radiation pass to the sensor surface of the sensor. Such filtering mechanism would be seen as part of the sensor, even if it is arranged remote from the actual sensor surface. Such filtering mechanism should be easily replaceable to enable detection of phosphorescent or fluorescent radiations at different wavelength, depending on the specific application. Alternatively, the sensor may use suitable electronics to process a detection signal to enable radiation specific detection.

The combination of raised print with the use of phosphorescent or fluorescent material in such raised print thus enables increased security with respect to authenticating printed products and thus with respect to counterfeiting. It enables automated authentication in a unit as described above as well as visual and tactile authentication by a person, for example selling or buying a product.

In the preferred approach, a clear toner using large toner particles is applied on top of a color image or a receiver member to form a three-dimensional texture. It should be kept in mind that textural information corresponding to the clear toner image plane need not be binary. In other words, the quantity of clear toner called for, on a pixel by pixel basis, need not only assume either 100% coverage or 0% coverage; it may call for intermediate "gray level" quantities, as well. In an area of the colored image to be covered with a clear toner for three-dimensional texture, the color may change due to the application of the clear toner. Such color change can be taken as is or can be corrected b< for example creating two color profiles. The first color profile being for 100% clear toner coverage on top, and the second color profile being for 0% clear toner coverage on top. On a pixel by pixel basis, proportional to the amount of coverage called for in the clear toner image plane, a third color profile can be created, and this third color profile interpolates the values of the first and second color profiles. Thus, a blending operation of the two color profiles can be used to create printing values.

The invention was described in view of certain embodiments thereof, without being limited to these specific embodiments.

What is claimed is:

1. A method for forming a printed product on a receiver member, said method comprising:

applying a plurality of toner layers on said receiver member for forming an image such that said image has at least one raised portion, said raised portion comprising a layer of phosphorescent or fluorescent toner particles; and fusing said toner layers to said substrate, wherein after fusing, a raised portion remains at least 15 μm above a surrounding area of the fused toner layers so that the raised portion is visible from a side elevation.

2. The method of claim 1, wherein the layer of phosphorescent toner particles is formed as an outer layer of at least a part of a surface of said raised portion.

3. The method of claim 1, wherein said raised portion is at least partially formed by:

applying at least one first toner layer of a first colour, and applying said layer of phosphorescent or fluorescent toner particles on top of at least portions of said first toner layer.

4. The method of claim 1, wherein said raised portion is at least partially formed by using large toner particles of a standard general average mean volume weighted diameter of more than 18 μm.

5. The method of claim 1, wherein said large toner particles have a standard general average mean volume weighted diameter of between 20 μm to 50 μm.

6. The method of claim 1, wherein said large toner particles have a standard general average mean volume weighted diameter of between 20 μm to 30 μm.

7. The method of claim 1, wherein said phosphorescent or fluorescent toner particles have a standard general average mean volume weighted diameter of more than 18 μm, preferably more than 20 μm.

8. The method of claim 1, wherein said image comprises at least one non-raised portion formed by standard toner particles of a standard general average mean volume weighted diameter of less than 15 μm, preferably less than 10 μm.

9. The method of claim 1, wherein said image is formed as a multi-colour image having raised portions overlaid thereon.

* * * * *